US005536899A

United States Patent [19]

Forrester

[11] Patent Number: 5,536,899

[45] Date of Patent: Jul. 16, 1996

[54] STABILIZATION OF LEAD BEARING WASTE

[76] Inventor: Keith E. Forrester, 883 Ocean Blvd., Hampton, N.H. 03843-2008

[21] Appl. No.: 318,538

[22] Filed: Oct. 5, 1994

Related U.S. Application Data

[63] Continuation-in-part of Ser. No. 38,812, Mar. 12, 1993, abandoned.

[51] Int. Cl.[6] ..... A62D 3/00; B09D 3/00

[52] U.S. Cl. ..... 588/256; 210/751; 588/260; 588/901

[58] Field of Search ..... 405/128, 129; 588/236, 256, 260, 901; 210/751

[56] References Cited

U.S. PATENT DOCUMENTS

| | | | |
|---|---|---|---|
| 4,049,462 | 9/1977 | Cocozza . | |
| 4,113,504 | 9/1978 | Chen et al. . | |
| 4,124,405 | 11/1978 | Quiénot . | |
| 4,375,986 | 3/1983 | Pichat . | |
| 4,536,034 | 8/1985 | Otto, Jr. et al. | 295/5 |
| 4,610,722 | 9/1986 | Duyvesteyn et al. | 75/97 |
| 4,629,509 | 12/1986 | O'Hara et al. . | |
| 4,671,882 | 6/1987 | Douglas et al. | 210/720 |
| 4,737,356 | 4/1988 | O'Hara et al. | 423/659 |
| 4,804,147 | 2/1989 | Hooper | 241/24 |
| 4,889,640 | 12/1989 | Stanforth | 210/751 |
| 4,948,516 | 8/1990 | Fisher et al. | 210/751 |
| 4,950,409 | 8/1990 | Stanforth | 210/751 |
| 4,975,115 | 12/1990 | Irons | 75/330 |
| 5,130,051 | 7/1992 | Falk | 210/751 X |
| 5,162,600 | 11/1992 | Cody et al. | 588/236 |
| 5,193,936 | 3/1993 | Pal et al. | 588/256 X |
| 5,202,033 | 4/1993 | Stanforth et al. | 588/236 X |
| 5,245,114 | 9/1993 | Forrester | 588/236 |
| 5,430,233 | 7/1995 | Forrester | 588/236 |
| 5,431,825 | 7/1995 | Diel | 588/256 X |

*Primary Examiner*—George A. Suchfield

*Attorney, Agent, or Firm*—Hamilton, Brook, Smith & Reynolds

[57] ABSTRACT

A method is disclosed for reducing the leaching of lead from a lead bearing waste, The method includes contacting the waste with a water soluble phosphate and a complexing agent, wherein the complexing agent is at least slightly water soluble, whereby a lead product is formed which is less soluble than the lead originally in the waste, thereby reducing the leaching of lead from the waste as determined by a leach test performed on the waste.

22 Claims, No Drawings

STABILIZATION OF LEAD BEARING WASTE

RELATED APPLICATIONS

This is a continuation-in-part of U.S. Ser. No. 8/038,812 filed Mar. 12, 1993, now abandoned, the teachings of which are incorporated herein by reference.

BACKGROUND OF THE INVENTION

The leaching of heavy metals from heavy metal bearing wastes has long been of concern to environmental regulators and waste producers. Under the Resource Conservation and Recovery Act, solid waste is classified by the U.S. Environmental Protection Agency (EPA) as hazardous waste if excessive amounts of heavy metals leach from the waste when tested according to the Toxicity Characteristic Leaching procedure (TCLP). In addition, several state governments require that heavy metal bearing wastes, having higher leaching levels, be directed to hazardous waste landfills. Disposal of waste at hazardous waste landfills is typically more expensive than disposal at non-hazardous waste facilities.

To reduce the expenses associated with the landfill disposal of heavy metal leachable waste, particularly lead bearing wastes, various methods to control heavy metal leaching have been developed. These methods include the treatment of lead bearing waste with, for example, phosphates, sulfides, calcium salts, metal oxides, vermicutite, aluminosilicates or portland cement. However, due to the mixing equipment and/or chemicals required, these methods are often expensive to perform. Additionally, some of these methods use chemicals, such as ferric chloride which, in the amounts used, are very corrosive to waste generation and/or treatment process equipment. Furthermore, some methods for reducing lead leaching can result in the formation of potential carcinogens, such as lead phosphate.

Thus, a need exists for means of reducing lead leaching, from lead bearing waste, which are less expensive and less damaging to equipment, and which do not form carcinogenic products.

SUMMARY OF THE INVENTION

The present invention relates to a method for reducing the leaching of lead from a lead bearing waste. The method includes contacting the waste with a water soluble phosphate and a complexing agent, wherein the complexing agent is at least slightly water soluble, whereby a lead product is formed which is less soluble than the lead originally in the waste, thereby reducing the leaching of lead from the waste as determined by a leach test performed on the waste.

This invention has the advantages of reducing the leachability of lead from lead bearing waste, under leach test conditions, at a lower price and with lesser amounts of phosphate and complexing agent. This invention has the additional advantage of reducing the corrosion, resulting from waste stabilization, of waste production and processing equipment.

DETAILED DESCRIPTION OF THE INVENTION

Waste stabilization is herein defined as reducing the leaching of lead from a lead bearing waste, as determined by performing a suitable leach test on the waste. Wastes suitable for stabilization, according to the method of invention, typically include solids in waste streams and waste piles. In a waste stream, the solid waste can optionally be entrained in a liquid or a gas. Examples of lead bearing wastes which can be stabilized include wastes from auto shredders' fluff, wire chop, electroplating processes, arc dust collectors, cupola metal furnaces, sand blasting, and sewage sludge drying beds. Additional examples of wastes suitable for stabilization include residues and products of the combustion, or partial combustion, of medical waste, commercial waste, industrial waste, sewage sludge and solid municipal waste. This method can also be used to stabilize foundry sand.

The lead, in the lead bearing waste to be stabilized, can be in elemental form and/or cationic form. Lead bearing waste can contain up to about 100 ppm, or more, of leachable lead. However, leachable lead levels, in wastes to be stabilized, are more typically between about 5 ppm to about 20 ppm.

Leach test conditions, as defined herein, include the conditions to which a waste is subjected during acetic acid leaching, citric acid leaching, other chelating leaching methods or extraction leaching. Suitable acetic acid leach tests include the Toxicity Characteristic Leaching procedure (TCLP), which is described by the EPA in the *USEPA SW-846 Manual*. Briefly, in a TCLP test, 100 grams of waste are stirred with 2 liters of dilute acetic acid for a period of 18 hours. The dilution of the acetic acid is 5.7 mLs of concentrated acetic acid per liter of water. Leachable lead, contained in the waste, then complexes with acetate anions to form lead acetate. A TCLP result of 5 ppm lead will result in the classification of the waste as hazardous waste.

Suitable citric acid leach tests include the California Waste Extraction Test (WET), which is described in Title 22, Section 66700, "Environmental Health" of the *California Health and Safety Code*. Briefly, in a WET test, 50 grams of waste are tumbled in a 1000 mL tumbler with 500 grams of sodium citrate solution for a period of 48 hours. Leachable lead, contained in the waste, then complexes with citrate anions to form lead citrate. The concentration of leached lead is then analyzed by Inductively-Coupled Plasma (ICP) after filtration of a 100 mL aliquot from the tumbler through a 45 micron glass bead filter. A WET result of $\geqq 5$ ppm lead will result in the classification of the waste as hazardous waste.

In this method for stabilizing lead bearing wastes, a suitable waste is contacted, under alkaline or neutral pH conditions, with a water soluble phosphate and a complexing agent. The complexing agent is typically at least slightly water soluble. When contacted with a phosphate and a complexing agent, lead in the waste forms a lead product, typically a mineral, or complex, which is less soluble than the lead originally in the waste, particularly under leach test conditions. For example, the minerals plumbogummite and chloropyromorphite are formed by contacting lead with $Al_2O_3$ or $Al_2O_3$ and chloride ions.

Examples of suitable water soluble phosphates include phosphoric acids, salts of phosphoric acids, $P_2O_5$, phosphate rock, combinations thereof and compositions containing one or more non-phosphate components in addition to phosphoric acid(s), phosphoric acid salt(s) and/or $P_2O_5$. Examples of such suitable compositions, containing one or more non-phosphate components, include "TRIPLE SUPER PHOSPHATE " fertilizer, which contains $P_2O_5$, and phosphoric acid co-product solution resulting from the chemical polishing, or finishing, of aluminum, which includes phosphoric acid and typically nitric acid and/or sulfuric acid. Suitable phosphoric acids include orthophosphoric acid, hypophosphoric acid, metaphosphoric acid and pyrophosphoric acid. Salts of phosphoric acids include, for instance, monoammonium phosphate, diammonium phosphate, disodium hydrogen phosphate, trisodium phosphate and combinations thereof.

In one embodiment, suitable complexing agents contain a multivalent metal cation component. The multivalent cation component is typically at least slightly water soluble. Suitable multivalent metal cation components contain, for instance, iron (II), iron (III), aluminum (III) or combinations thereof. Examples of suitable multivalent metal cation components include $Fe(NO_3)_3$, $FeSO_4$, $Fe_2(SO_4)_3$, $FeCl_3$, $Al_2(SO_4)$, $Al_2O_3$, aluminosilicate and combinations thereof.

In an alternate embodiment, suitable complexing agents contain a chloride component which is contained in an aqueous solution or is in the form of a solid water soluble salt. An example of a suitable chloride component is table salt.

The amounts of water soluble phosphate and complexing agent used, according to the method of invention, depend upon various factors, such as the type of waste being stabilized, chemical makeup of the waste, waste porosity, waste cohesiveness, the amount of waste, the concentration of lead within the waste, whether the waste is in a waste stream or a waste pile, and waste treatment objectives, such as the desired final concentration of leachable lead. The amounts of phosphate and complexing agent needed to treat a specific waste can be readily determined by one of ordinary skill in the art through performing one or more leaching tests, such as TCLP or WET, on a sample of the waste.

Typically, the minimum concentrations of phosphate and complexing agent in a treated lead bearing waste, which are needed to stabilize said waste, are about 0.1 wt. % phosphate and about 0.01 wt. % complexing agent.

The stabilization of lead bearing wastes, with various phosphates and complexing agents, is further described in the Example.

It is understood that the phosphate and the complexing agent can be added to the waste either separately, concurrently, in combination, sequentially, intermittently, or in any other sequence or order. It is also understood that the phosphate and/or complexing agent can be added to the waste as solids, in aqueous solution or in a slurry. Furthermore, the phosphate and complexing agent can be contacted with the waste without mixing with the waste, or optionally, with mixing.

In this method, the phosphate and complexing agent can be applied during waste generation, applied to waste contained in a waste stream and/or applied to waste stored in a waste pile. In one embodiment, a phosphate and complexing agent are added to the source of a lead bearing waste prior to generating said lead bearing waste. For example, phosphate and complexing agent can be sprayed, coated, added, mixed or otherwise contacted with copper wire insulation before chopping the copper wire, thereby producing a stabilized lead bearing waste.

In another embodiment, phosphate and complexing agent are coated onto equipment which produces the waste. For example, phosphate and complexing agent can be sprayed, coated or otherwise contacted with wire chopping equipment, prior to, or during operation.

In yet another embodiment, phosphate and complexing agent are contacted with waste contained in a waste stream, typically without restricting the free flow of the waste stream. For example, phosphate and complexing agent can be directed onto or into waste in a free flowing waste stream by injection, spraying, coating or other suitable means. Alternatively, phosphate and complexing agent can be coated onto equipment which directs and/or transports waste in a waste stream. For example, phosphate and complexing agent can be sprayed, coated or otherwise contacted with equipment for conveying wire chop waste, such as a screw conveyor, prior to or during equipment operation. Further, for incinerator units, a phosphate and complexing agent can be sprayed, coated or otherwise contacted with gas/solid separators, for separating solids from combustion gases, such as cyclone separators or vortex separators, thereby treating the solid waste while separating the solid waste from the gaseous waste product.

In a further embodiment, phosphate and complexing agent can be contacted with waste contained in a waste pile. Typically, the phosphate and complexing agent are added to the surface of the waste pile. Optionally, the phosphate and the complexing agent are directed into the waste pile. Suitable means for directing the phosphate and complexing agent into the waste pile include, for instance, tilling and/or irrigation with surface or subsurface water sprays or water injection. If mixing through tilling, the phosphate and complexing agent are usually mixed into the waste pile to a depth of about one to three feet.

The invention will now be further and more specifically described by the following example.

EXAMPLE

Reduction of Lead Leaching From Wastes

Lead bearing wastes were treated with various amounts of several phosphates and/or complexing agents to evaluate the effect of treatment upon the lead leachability of the wastes. The wastes treated included copper wire insulation (CWI) from wire chop processes, bottom ash (BA) from a refuse-to-energy facility, flyash scrubber residue (FASR), collected from air pollution control devices as a mixture of air entrained flyash and residual scrubbing products from CaO injection, and lead contaminated soil (Pb soil).

The phosphates used included technical grade phosphoric acid (75 wt% $H_3PO_4$ and 25 wt% $H_2O$, hereinafter "$_{tg}H_3PO_4$"), the dry fertilizer "TRIPLE SUPER PHOSPHATE" (TSP), containing 18 wt. % nitrogen and 46 wt. % $P_2O_5$, purchased from Solutions, Inc. (Franklin, Mass.) and phosphoric acid co-product solution (COP), resulting from chemical polishing of aluminum and consisting essentially of 35–37 wt. % $H_3PO_4$, 25–27 wt. % $P_2O_5$, 5–8 Wt.% $H_2SO_4$, 1–2 wt. % dissolved aluminum and 0.5–0.7 wt. % $HNO_3$. COP was also purchased from Solutions, Inc. (Franklin, MA).

The complexing agents used consisted of an aqueous solution $Fe(NO_3)_3$ containing 10.25 wt. % Fe(III), aqueous $Fe_2(SO_4)_3$ solution containing approximately 10 wt. % Fe(III), 30 wt. % $FeCl_3$ aqueous solution, "MORTON'S TABLE SALT" containing 1 wt. % NaCl and silicoalumina, "LIQUID ALUMINUM SULFATE", an aluminum sulfate aqueous solution purchased from Holland Company Inc. (Adams, Mass.), $Al_2O_3$ and milled bauxite, containing 74.2 wt. % $Al_2O_3$ and 7.6 wt. % $Fe_2O_3$.

Following mixing with the phosphate and/or co agent, each waste sample, and each waste sample control, was tested for lead leachability utilizing the EPA's acetate TCLP test. The leach tests results obtained are shown in the following table:

| Waste | Post-Treatment Waste Composition (by weight percent) | Pb Leach (ppm) |
|---|---|---|
| CWI | Untreated CWI (CWI control) | 24.30 |
| CWI | 99% CWI and 1.0% $_{tg}H_3PO_4$ | 19.00 |
| CWI | 97% CWI and 3.0% $_{tg}H_3PO_4$ | 0.12 |
| CWI | 95% CWI and 5% TSP | 0.17 |
| CWI | 99% CWI and 1.0% $Fe_2(SO_4)_3$ | 3.70 |
| CWI | 99% CWI, 0.5% $_{tg}H_3PO_4$ & 0.5% $FeCl_3$ | <0.05 |
| CWI | 98.5% CWI, 1.0% $_{tg}H_3PO_4$ & 0.5% $FeCl_3$ | <0.05 |
| CWI | 97.75% CWI, 2.0% $_{tg}H_3PO_4$ & 0.25% $Fe(NO_3)_3$ | <0.05 |
| CWI | 97.25% CWI, 2.5% $_{tg}H_3PO_4$ & 0.25% $Fe(NO_3)_3$ | 0.06 |
| CWI | 98% CWI, 1.0% $_{tg}H_3PO_4$ & 1.0% NaCl | 2.30 |
| CWI | 98.5% CWI, 1.0% $_{tg}H_3PO_4$ & 0.5% $Al_2O_3$ | <0.05 |
| CWI | 98% CWI, 1.0% $_{tg}H_3PO_4$ & 1.0% Bauxite | <0.05 |
| CWI | 98% CWI and 2.0% COP | 0.20 |
| CWI | 98% CWI, 1.5% COP and 0.5% $FeCl_3$ | <0.05 |
| CWI | 98% CWI, 0.5% COP, 0.5% $Fe_2(SO_4)_3$ and 1.0% $H_2O$ | 0.07 |
| CWI | 97% CWI, 0.99% $_{tg}H_3PO_4$, 0.03% $FeCl_3$, 0.03 $Al_2(SO_4)_3$ and 19.5 $H_2O$ | <0.05 |
| CWI | 99% CWI, 0.33% $_{tg}H_3PO_4$, 0.01% $FeCl_3$, 0.01 $Al_2(SO_4)_3$ and 6.5 $H_2O$ | <5.00 |
| BA | Untreated BA (BA Control) | 6.30 |
| BA | 99.3% BA, 0.2% $_{tg}H_3PO_4$ & 0.5% $FeCl_3$ | <0.05 |
| FASR | Untreated FASR (FASR Control) | 36.80 |
| FASR | 99% FASR, 0.5% $_{tg}H_3PO_4$ & 0.5% $FeCl_3$ | 1.90 |
| BA/FASR | 99% BA/FASR, 0.5% $_{tg}H_3PO_4$ & 0.5% $FeCl_3$ | <0.05 |
| Pb Soil | | 87.00 |
| Pb Soil | 97% Pb Soil and 3.0% COP | 1.7 |

The leach test results demonstrated that treatments of lead bearing wastes, with a combination of a phosphate and a complexing agent generally resulted in lower lead leaching level than did treatment of waste with only a phosphate or with a complexing agent.

Equivalents

Those skilled in the art will recognize, or be able to ascertain using no more than routine experimentation, many equivalents to specific embodiments of the invention described specifically herein. Such equivalents are intended to be encompassed in the scope of the following claims.

The invention claimed is:

1. A method for reducing the leaching of lead from a lead bearing waste, consisting essentially of contacting said waste with a water soluble phosphate and a complexing agent containing Fe(II), Fe(III), Al(III), chloride or combination thereof, wherein the complexing agent is at least slightly water soluble, whereby a lead product is formed which is less soluble than the lead originally in said waste, thereby reducing the leaching of lead from said waste as determined by a leach test performed on said waste.

2. A method for reducing the leaching of lead from a lead bearing waste, consisting essentially of contacting said waste, under alkaline or neutral pH conditions, with a water soluble phosphate and a complexing agent containing Fe(II), Fe(III), Al(III), chloride or combination thereof, wherein the complexing agent is at least slightly water soluble, whereby a lead product is formed which is less soluble than the lead originally in said waste, thereby reducing the leaching of lead from said waste as determined by a leach test performed on said waste.

3. A method of claim 2 wherein said water soluble phosphate comprises a phosphate selected from the group consisting of phosphoric acids, salts of phosphoric acids, $P_2O_5$, phosphate rock and combinations thereof.

4. A method of claim 3 wherein said salts of phosphoric acids include monoammonium phosphate, diammonium phosphate, disodium hydrogen phosphate, trisodium phosphate and combinations thereof.

5. A method of claim 2 wherein the complexing agent contains a multivalent metal cation component selected from the group consisting of $Fe(NO_3)_3$, $FeSO_4$, $Fe_2(SO_4)_3$, $FeCl_3$ and combinations thereof.

6. A method of claim 2 wherein the complexing agent contains a multivalent metal cation component selected from the group consisting of $Al_2(SO_4)_3$, $Al_2O_3$, aluminosilicate and combinations thereof.

7. A method of claim 2 wherein the water soluble phosphate and complexing agent are added to the source of the lead bearing waste prior to generating said lead bearing waste.

8. A method of claim 2 wherein the lead bearing waste is contained in a waste stream.

9. A method of claim 8 wherein the water soluble phosphate and complexing agent are contacted with waste stream equipment prior to or during the generation of lead bearing waste.

10. A method of claim 2 wherein the lead bearing waste is contained in a waste pile.

11. A method of claim 10 wherein the lead bearing waste, the water soluble phosphate and the complexing agent are mixed by tilling.

12. A method of claim 2 further comprising the step of contacting water with the lead bearing waste during or after contacting the water soluble phosphate and the complexing agent with said waste.

13. A method of claim 12 further comprising the step of contacting sulfuric acid with said waste.

14. A method for reducing lead leaching from a waste, when said waste is subjected to leach test conditions, consisting essentially of the steps of:

a) contacting said waste with a phosphoric acid solution; and b) contacting said waste with ferric sulfate whereby a lead product is formed which is less soluble than the lead originally in said waste, thereby reducing the leaching of lead from said waste as determined by a leach test performed on said waste.

15. A method of claim 14 wherein the ferric sulfate is at least partially dissolved in an aqueous solution.

16. A method of claim 15 wherein the phosphoric acid solution contains sulfuric acid.

17. A method of claim 16 wherein the phosphoric acid solution comprises a phosphoric acid waste product resulting from the chemical polishing or finishing of aluminum.

18. A method for reducing the leaching of lead from a lead bearing waste contained in a waste stream, comprising contacting waste stream equipment prior to or during the generation of said lead bearing waste, under alkaline or neutral pH conditions, with a water soluble phosphate and a complexing agent containing Fe(II), Fe(III), Al(III), chloride or combination thereof, wherein the complexing agent is at least slightly water soluble, whereby a lead product is formed which is less soluble than the lead originally in said waste, thereby reducing the leaching of lead from said waste as determined by a leach test performed on said waste.

19. A method for reducing the leaching of lead from a lead bearing waste, comprising contacting said waste with a composition comprising a water soluble phosphate and a complexing agent containing Fe(II), Fe(III), Al(III), chloride or combination thereof, wherein the complexing agent is at least slightly water soluble, whereby a lead product is formed which is less soluble than the lead originally in said waste, thereby reducing the leaching of lead from said waste as determined by a leach test performed on said waste.

20. A method of claim 19 wherein said water soluble phosphate comprises a phosphate selected from the group consisting of phosphoric acids, salts of phosphoric acids, $P_2O_5$, phosphate rock and combinations thereof.

21. A method of claim 20 wherein said salts of phosphoric acids include monoammonium phosphate, diammonium phosphate, disodium hydrogen phosphate, trisodium phosphate and combinations thereof.

22. A method of claim 19 wherein the complexing agent contains a multivalent metal cation component selected from the group consisting of $Fe(NO_3)_3$, $FeSO_4$, $Fe_2(SO_4)_3$, $FeCl_3$, $Al_2(SO_4)_3$, $Al_2O_3$, aluminosilicate and combinations thereof.

* * * * *

UNITED STATES PATENT AND TRADEMARK OFFICE

CERTIFICATE OF CORRECTION

PATENT NO. : 5,536,899

DATED : July 16, 1996

INVENTOR(S) : Keith E. Forrester

It is certified that error appears in the above-indentified patent and that said Letters Patent is hereby corrected as shown below:

In column 5, in the table at line 20, change 19.5 to --1.95%--

In column 5, in the table at line 22, change 6.5 to --0.65%.

Signed and Sealed this

Twenty-fifth Day of February, 1997

*Attest:*

Bruce Lehman

BRUCE LEHMAN

*Attesting Officer*

*Commissioner of Patents and Trademarks*